US005585828A

United States Patent [19]

Cavarero

[11] Patent Number: 5,585,828

[45] Date of Patent: Dec. 17, 1996

[54] THERMAL PRINTER

[75] Inventor: Eric Cavarero, Sainte Honorine, France

[73] Assignee: Societe d'Applications Generales d'Electricite et de Mecanique Sagem, France

[21] Appl. No.: 285,420

[22] Filed: Aug. 3, 1994

[30] Foreign Application Priority Data

Aug. 3, 1993 [FR] France ..... 93 09540

[51] Int. Cl.[6] ..... B41J 2/315; B41J 2/32

[52] U.S. Cl. ..... 347/171

[58] Field of Search ..... 346/136; 358/296, 358/498; 235/145 R, 2, 3, 4, 1 D; 400/613, 611; 347/171

[56] References Cited

U.S. PATENT DOCUMENTS 4,949,097 8/1990 Imaseki ..... 347/188
5,201,588 4/1993 Sakai et al. ..... 400/613

FOREIGN PATENT DOCUMENTS 152980 9/1982 Japan ..... 400/613

OTHER PUBLICATIONS

English Translation of Patent Abstracts of Japan, vol. 11, No. 50 (M-562) (2497) 17 Feb., 1987, & JP-A-61 213 172 (Toshiba Corp.).

English Translation of Patent Abstracts of Japan, vol. 8, 164 (M-313) (1601), 28 Jul., 1984, & JP-A-59 059 470 (Toshiba K.K.).

English Translation of Patent Abstracts of Japan, vol. 10, No. 307 (M-527) (2363), 18 Oct., 1986, & JP-A-61 120 773 (Canon Inc.).

English Translation of Patent Abstracts of Japan, vol. 7, No. 223 (M-247) (1368), 4 Oct., 1983, & JP-A-58 118 271 (Fuji Xerox K.K.).

English Translation of Patent Abstracts of Japan, vol. 10, No. 174 (M-490) (2230), 19 Jun., 1986, & JP-A-61 022 965 (Toshiba K.K.).

*Primary Examiner*—Benjamin R. Fuller
*Assistant Examiner*—L. Anderson
*Attorney, Agent, or Firm*—Graham & James LLP

[57] ABSTRACT

Thermal printer comprising a thermal printing head (201), elements (202) for driving a paper medium (220) in front of the printing head (201), elements (204) for introducing sheets of paper (220), means for extracting sheets of paper (220), means for driving a thermal-transfer printing ribbon (214) in front of the printing head (201), the printer being designed to receive a roll of paper (233) and the extraction elements being designed to unroll the roll of paper (233).

4 Claims, 3 Drawing Sheets

THERMAL PRINTER

BACKGROUND OF THE INVENTION

The invention relates to thermal printers, both in the context of printers which are peripherals of other equipment and apparatuses with integrated printer, such as, for example, facsimile machines.

More particularly, the invention relates to thermal printers in which a thermal printing head with resistive heating elements is provided for printing, on an a priori paper medium, pages of a document which is to be received from a calling party in the case of a facsimile machine. There are two main types of thermal printer.

In those of the first type, currently the most widespread, the medium is a special so-called thermal paper used in roll form.

In printers of the second type, which are starting to appear on the market, the medium is ordinary paper, then used in sheets or in reams, but which requires a special printing ribbon used in roll form. This is, more precisely, a ribbon coated with a layer of thermally meltable ink which, during printing, is transferred onto a sheet of the paper by activation of the heating elements of the head. In this case, printing by thermal transfer is spoken of.

With the former printers, there is the risk that the roll of thermal paper will end prematurely or unexpectedly.

With the latter printers, there is also the risk that the inking roll will end prematurely or unexpectedly.

Since the solution of providing two printers, respectively of the two types, is naturally to be set aside, the Applicant Company has sought to overcome the risk of the roll of thermal paper or inking ribbon running out, and it is in this context that it provides its invention.

SUMMARY OF THE INVENTION

The invention relates to a thermal printer comprising a thermal printing head, means for driving a paper medium in front of the printing head, means for introducing sheets of paper, means for extracting sheets of paper, means for driving a thermal-transfer printing ribbon in front of the printing head, the printer being designed to receive a roll of paper and the extraction means being designed to unroll the roll of paper.

It will be noted that the Applicant Company does not desire, for defining its invention, to start with a printer of one or other of the two types introduced hereinabove, having no more reason to base the invention on one or the other.

The means for driving the paper medium, in sheets or in roll form, generally comprise a support roller. The means for introducing the sheets of paper are provided in the printer of the invention, but they naturally cannot be used in the case of a paper medium in roll form.

The printer is designed to accommodate a roll of thermal paper, but it is again not possible to make use of such an arrangement.

BRIEF DESCRIPTION OF THE DRAWINGS

The invention will be better understood with the aid of the following description of four preferred embodiments of the printer of the invention, with reference to the attached drawing, in which.

Figure 1:
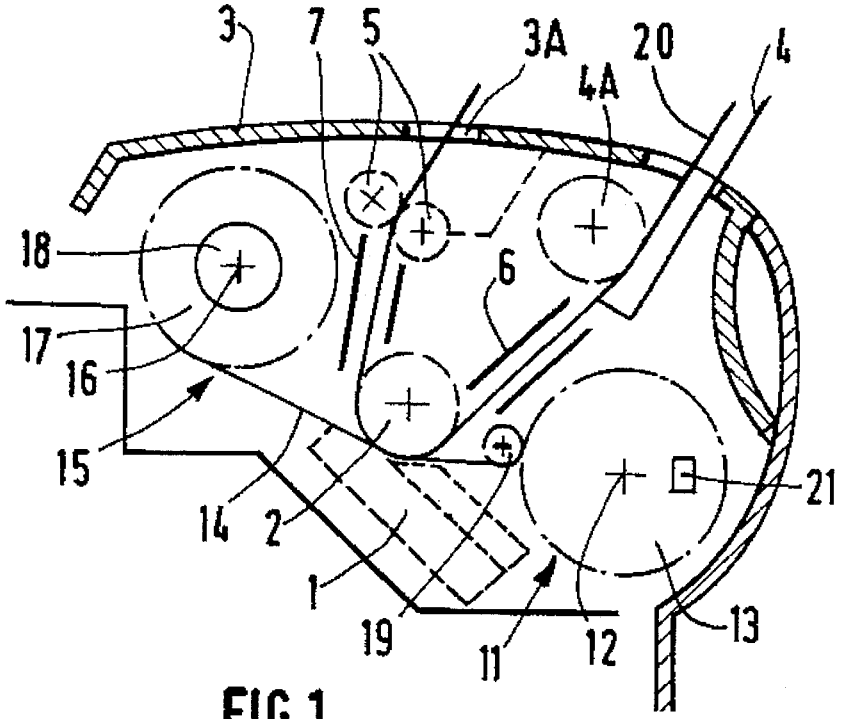
FIG. 1 is a schematic side view of the first preferred embodiment of the printer of the invention, using a thermal-transfer printing inking ribbon.

The printer represented in FIG. 1 belongs to a facsimile machine and includes a thermal printing head 1 and a support roller 2 arranged opposite.

For brevity of the explanation, it will be noted that all the axes of the Figures extend perpendicularly to the plane of the Figures.

DETAILED DESCRIPTION OF THE PREFERRED EMBODIMENT

A hood 3 of the printer supports an intake magazine 4 associated with an introduction roller 4A designed to receive a ream of sheets of paper 20 to be printed, while two extraction wheels 5 extract the sheets of paper 20 which emerge through a slot 3A of the hood 3. Two feeder necks 6 and 7 are designed to guide the paper 20, respectively entering and leaving the magazine 4 towards the head 1 and the roller 2, while passing between the two of them, and from the head 1 towards the extraction wheels 5 and the slot 3A.

A housing 11 of the printer here includes a fixed spindle 12 carrying a delivery roller 13 for the thermal printing ribbon 14, while a housing 15 includes a drive spindle 16 carrying a take-up roller 17 for spent ribbon 14, this roller being coupled in rotation with this spindle. The ribbon 14 passes from the delivery roller 13 to the take-up roller 17 while being pressed flat against the head 1, between it and the support roller 2. The support roller 2 is driven in rotation by a gearing, not represented, common to the extraction wheels 5 and also, by friction, drives the paper 20 and the ribbon 14.

A drive motor 18 rotationally drives the spindle 16 and unwinds the ribbon 2 against the action of the guidewheel 19 arranged at the exit of the housing 11.

A proximity detector 21 is also provided in this example for the roller 13 delivering the ribbon 14.

Figure 2:
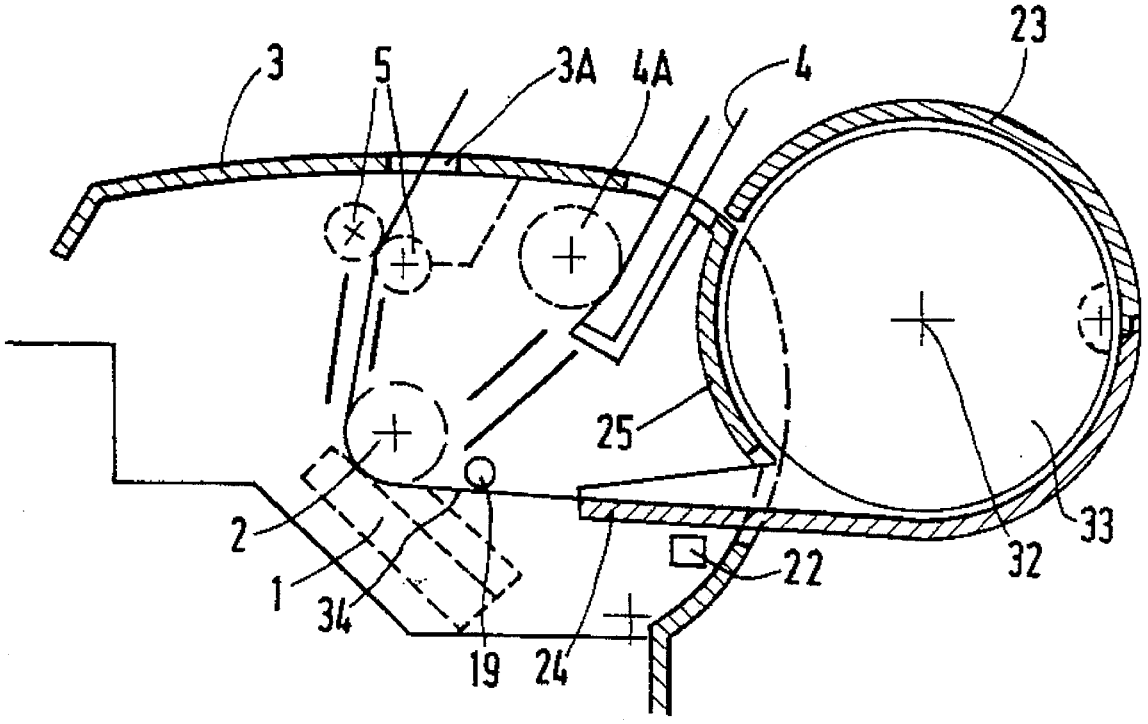
FIG. 2 represents the printer of FIG. 1, then using a roll of thermal paper.

The same printer is represented in FIG. 2, but it is in this case equipped with a removable container 23 designed to accommodate a roll 33 of heat-sensitive paper 34, here carried by a spindle or hub 32. The container 23 is fixed in a removable manner, not shown, by snap fastening on the hood 3, and includes a guide neck 24 for feeding the heat-sensitive paper 34 to the printing head 1. The hood 3 here has an external surface 25 of circular cylindrical shape which is locally concave and matches the shape of the container 23 to enclose the paper 33.

A detector 22 is provided for detecting the presence of the roll of paper 33. The detectors 21 and 22 are used for improving the controlling of the guiding of the thermal paper 33 as it emerges and for regulating the control of the printing head 1 as a function of the type of printing, by ribbon or with heat-sensitive paper.

Figure 3:
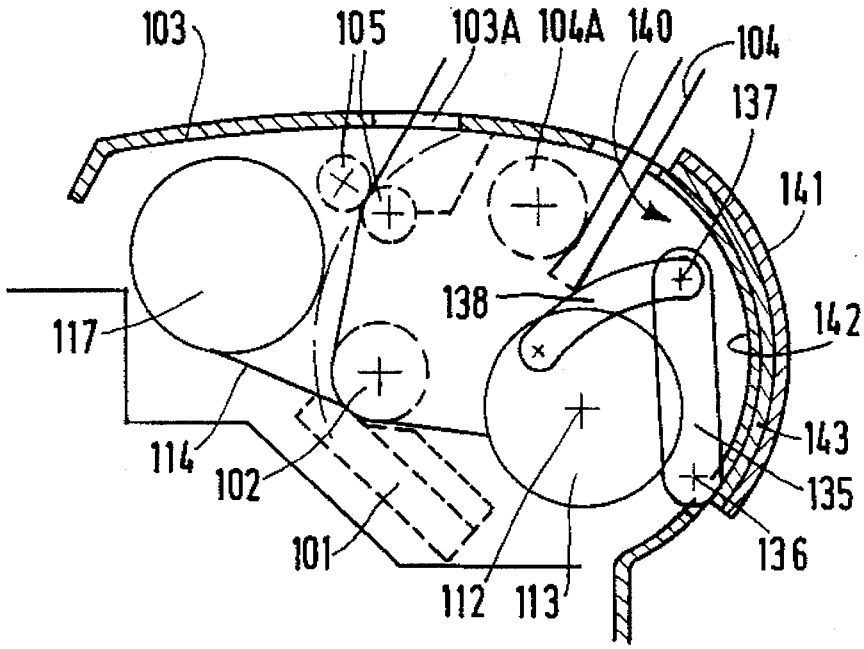
FIG. 3 is a schematic side view of the second preferred embodiment of the printer of the invention, using a thermal-transfer ribbon.

The second example, represented in FIG. 3, is similar to that in FIG. 1 and the printer, still belonging to a facsimile machine, uses a roll 113 of consumable heat-sensitive ribbon 114. The elements of FIGS. 3 and 4 which are similar to those of FIGS. 1 and 2 bear the same reference, but preceded by the hundred digit 1 and the ten digit 1 as appropriate. For this reason, they are not described a second time.

Figure 4:
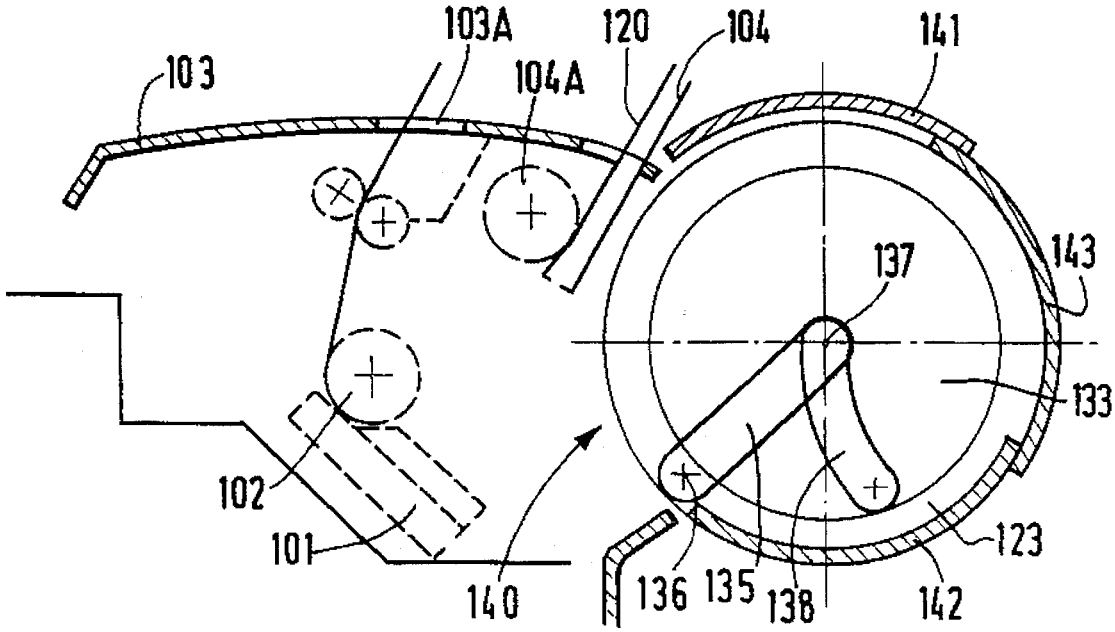
FIG. 4 represents the printer of FIG. 3, then using a roll of thermal paper.

In FIG. 4, which is similar to FIG. 2, the printer functions with a roll 133 of thermal paper. The hood 103 includes an opening 140 bordered by two rotary flaps 141 and 142 which open outward to accommodate the roll 133 of thermal paper. A slide flap 143 is slidingly mounted on the flap 141 in order, when deployed, to rejoin the external edge of the flap 142 and thus close the housing 123 of the roll of paper 133.

A pair of connecting rods, only one 135 of which is represented, are rotationally mounted at one end about a spindle 136 close to the junction of the flap 142 with the hood 103, and they respectively include, at opposite ends, two bearings 137 about which a pair of other connecting rods are respectively rotationally mounted, one, 138, of which is represented. The connecting rods 135 and 138 are axially separated in order to enclose the roll 133 by its flanks. The bearings 137 are designed to receive the hub 132 of the roll 133. The connecting rods 138 laterally hold the paper of the roll 133 and, in this example, also brake it.

As shown by FIG. 3, the flaps 141–143 occupy a folded position at rest, in which they lie on top of one another and close the hood 103, while the connecting rods 135 and 138 are folded inside the hood 103.

Thus, the connecting rods 135 and 138 which are designed to accommodate the hub 132 of the roll 133, are mounted movably from a position of thermal-transfer printing and supporting the roll 113 of inking ribbon to a position of direct printing and supporting the roll 133 of thermal paper. For their part, the flaps 141–143 are movable between a closed position and an open position for accommodating the roll 133 of thermal paper.

Figure 5:
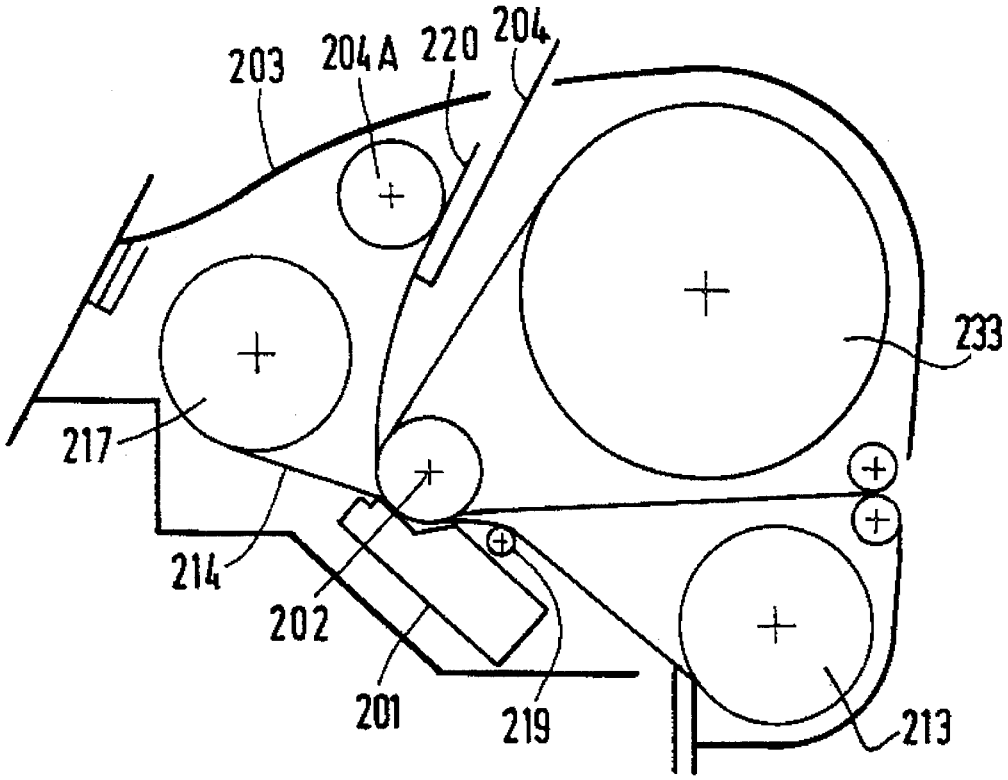
FIGS. 5 and 6 are side views of a third and of a fourth preferred embodiment of the printer of the invention.
Figure 6:
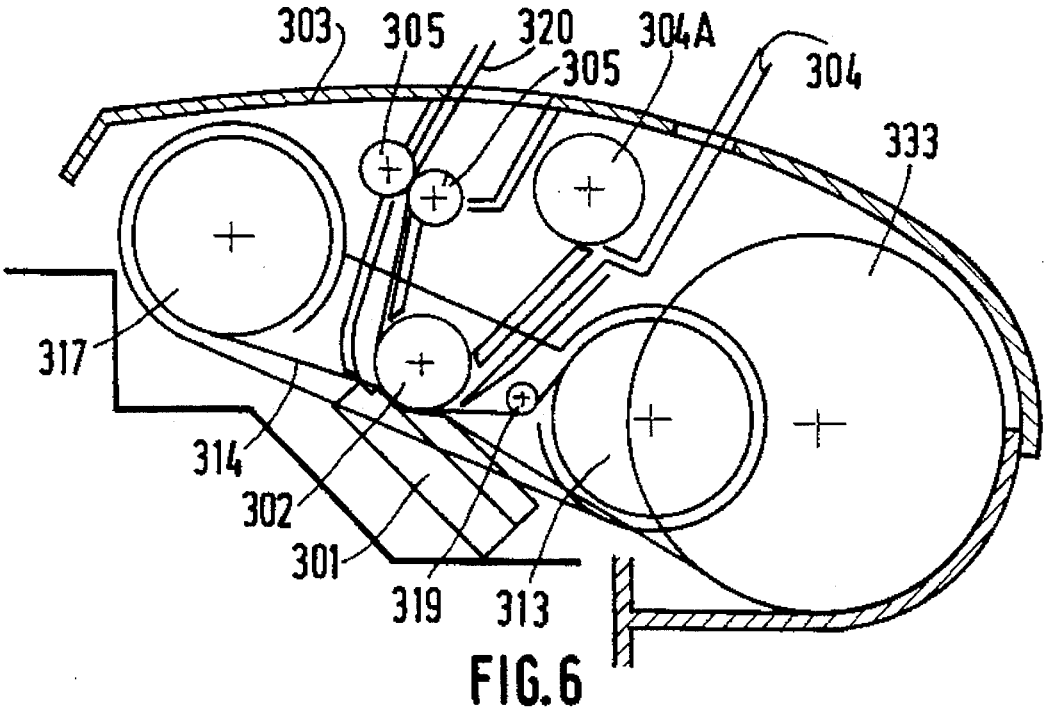

The elements of the printers of the third and fourth embodiments, represented in FIGS. 5 and 6, which are similar to those of the preceding figures bear the same references, respectively with a hundred digit 2 and 3.

In FIG. 5, the tape delivery roller 213 and the roll of heat-sensitive paper 233 are housed in the printer, in this case side by side.

In FIG. 6, the presences of the tape delivery roller 313 and the roll of heat-sensitive paper 333 are mutually exclusive because they occupy housings having a common volume.

I claim:

1. A thermal printer comprising a thermal printing head (1), means (2, 5) for driving a paper medium (20, 34) in front of the printing head (1), means (4) for introducing sheets of paper (20) in said printer, means (5) for extracting sheets of paper (20) from the means (4) for introducing sheets of paper (20), means in said printer (18) for driving a thermal-transfer printing ribbon (14) in front of the printing head (1), means for receiving a roll of paper (33) and wherein the extraction means (5) is adapted to unroll the roll of paper (33), the printer further comprising means (135, 138) for accommodating a roll hub for the roll of paper (33) and for supporting a roll (113) of inking ribbon, wherein the means (135, 138), which accommodate the roll hub and support the roll of inking ribbon, are mounted whereby the means for accommodating the roll hub and for supporting the roll of inking ribbon are movable, from a position of thermal-transfer printing and supporting the roll of inking ribbon, to a position of direct printing and supporting the roll of thermal paper.

2. The printer according to claim 1, wherein the means (2, 5) for driving the paper medium (20, 34) comprise a support roller (2).

3. The printer according to claim 1, wherein the printer further comprises means adapted for accommodating and fastening a feeder neck (24) of a container (23) of a roll of paper (33).

4. The printer according to claim 1, wherein the printer further comprises flaps (141–143) which are movable between a closed position and an open position for accommodating a roll (133) of thermal paper therewithin.

* * * * *